US007273323B2

(12) United States Patent
Troman

(10) Patent No.: US 7,273,323 B2
(45) Date of Patent: Sep. 25, 2007

(54) PRINTING APPARATUS AND METHODS

(75) Inventor: David Anthony Troman, Gotham (GB)

(73) Assignee: Markem Technologies Limited, Nottingham (GB)

( * ) Notice: Subject to any disclaimer, the term of this patent is extended or adjusted under 35 U.S.C. 154(b) by 0 days.

(21) Appl. No.: 10/523,480

(22) PCT Filed: Aug. 6, 2003

(86) PCT No.: PCT/GB03/03424

§ 371 (c)(1),
(2), (4) Date: Oct. 17, 2005

(87) PCT Pub. No.: WO2004/012943

PCT Pub. Date: Feb. 12, 2004

(65) Prior Publication Data

US 2006/0115310 A1 Jun. 1, 2006

(30) Foreign Application Priority Data

Aug. 6, 2002 (GB) ..... 0218216.0

(51) Int. Cl.
*B41J 2/315* (2006.01)

(52) U.S. Cl. ..... 400/120.17; 347/198; 347/220

(58) Field of Classification Search ..... None
See application file for complete search history.

(56) References Cited

U.S. PATENT DOCUMENTS 4,015,701 A * 4/1977 Templeton ..... 400/611
4,329,075 A 5/1982 Applegate et al.
4,844,632 A * 7/1989 Minowa ..... 400/120.17
4,924,240 A * 5/1990 Herbert et al. ..... 347/217
5,366,302 A 11/1994 Masumura et al.

(Continued)

FOREIGN PATENT DOCUMENTS

EP 0555556 12/1992

(Continued)

*Primary Examiner*—Jill E. Culler
(74) *Attorney, Agent, or Firm*—Fish & Richardson P.C.

(57) ABSTRACT

A printing apparatus (10) has at a printing station (11), a print head (12) with an array (13) of heating elements individually selectable by a computer controller (15), a feed path (16) for feeding carrier ribbon (18) through the printing satation (11), the carrier ribbon (18) carrying a layer of thermally sensitive print medium, pixels of the thermally sensitive print medium being in use deposited on a print area of a substrate (20), by selectively energizing the heating elements, as the substrate (20) and print head (12) are relatively moved, the apparatus (10) including a backing member (22) and the substrate (20) being position in use between the backing member (22) and the carrier ribbon (1.8), and wherein the print head (12) is mounted by amounting structure (25) for generally linear movement towards and away from the substrate (20), one of the mounting structure (25) and print head (12) including a projecting part which projects towards the other and at least during printing engages with the other of the mounting structure (25) and print head (12), and there being a resilient member (31) between the mounting structure (25) and the print head (12) which allows resiliently resisted movement between the mounting structure (25) and the print head (12) with the project part engaged with the other of the mounting structure (25) and print head (12) and there being at least one fastener (30) to couple the mounting structure (25) and print head (12) together.

13 Claims, 2 Drawing Sheets

U.S. PATENT DOCUMENTS

| | | | | |
|---|---|---|---|---|
| 5,576,751 | A | 11/1996 | Wada et al. | |
| 6,095,701 | A * | 8/2000 | Sattler | 400/120.17 |
| 6,247,859 | B1 | 6/2001 | Butcher | |
| 6,549,224 | B2 * | 4/2003 | Connor | 347/198 |
| 2002/0080223 | A1 * | 6/2002 | Connor | 347/198 |

FOREIGN PATENT DOCUMENTS

| | | |
|---|---|---|
| EP | 0361826 | 3/1995 |
| EP | 1018435 | 7/2000 |
| GB | 2250478 | 6/1992 |
| GB | 2259277 | 3/1993 |
| JP | 4069269 | 3/1992 |
| JP | 11227236 | 8/1999 |

* cited by examiner

PRINTING APPARATUS AND METHODS

This invention relates to a printing apparatus and to a method of printing.

So called thermal printers are known which include a printing station at which there is a print head with an array of heating elements, usually in a linear array, the heating elements being individually selectable by a computer controller, the apparatus further including a feed path for feeding carrier ribbon through the printing station, the carrier ribbon carrying a layer of thermally sensitive print medium, pixels of the thermally sensitive print medium being in use deposited on a print area of a substrate, by selectively energizing the heating elements, as the substrate and print head are relatively moved.

Such printing apparatus are either continuous i.e. the print head is maintained generally stationary at the printing station while the substrate and carrier are moved, usually continuously through the printing station, or intermittent i.e. the print head is moved at the printing station whilst the substrate and carrier are stationary or are moved, in each case to achieve relative movement between the print head and the substrate and carrier.

During printing the print head is moved towards the substrate which is supported by a backing member, to bring the heating elements into contact with the carrier and to urge the carrier and substrate together against the backing member to enable the pixels of print medium to be deposited on and peeled from the carrier ribbon, and after printing the print head is moved away from the substrate.

In one previous arrangement, the print head has been mounted on a mounting structure such that the print head is pivoted towards and away from the substrate, for example by a pneumatic or other actuator. Such a pivot mounting requires some compliance so that any misalignment in the mechanism, typically in the positioning or construction of the backing member, and/or variations in thickness of the substrate, can be accommodated. However such compliance can detrimentally affect print quality.

Moreover although the pivot mounting of the print head provides a reliable mounting for achieving movement of the print head towards and away from the substrate, this is not ideal. This is because the heating elements operate effectively to remove pixels of print medium only when in a particular orientation with respect to the substrate and carrier, and even small deviations from this orientation, which are inherent in a pivotal mounting, can affect heating element efficiency.

According to a first aspect of the invention we provide a printing apparatus having at a printing station, a print head with an array of heating elements individually selectable by a computer controller, a feed path for feeding carrier ribbon through the printing station, the carrier ribbon carrying a layer of thermally sensitive print medium, pixels of the thermally sensitive print medium being in use deposited on a print area of a substrate, by selectively energizing the heating elements, as the substrate and print head are relatively moved, the apparatus including a backing member and the substrate being positioned in use between the backing member and the carrier ribbon, and wherein the print head is mounted by a mounting structure for generally linear movement towards and away from the substrate, one of the mounting structure and print head including a projecting part which projects towards the other and at least during printing, engages with the other of the mounting structure and print head, there being a resilient member between the mounting structure and the print head, which allows resiliently resisted movement between mounting structure and print head with the projecting part engaged with the other of the mounting structure and the print head, and there being at least one fastener to couple the mounting structure and print head together.

In such an apparatus, the print head may thus move linearly towards and away from the substrate to assist in preserving the critical heating element orientation with respect to the substrate, whilst the provision of the projecting part and resilient member allows some compliance to accommodate any misalignment in the mechanism, and/or variations in thickness of the substrate.

Preferably the resilient member is a spacer, the spacer having a thickness slightly greater than the extent of projection of the projecting part.

The spacer may be provided by one or more blocks of rubber or a closed cell foam material, or another similar material which allows some relative movement between the print head and the mounting structure.

The projecting part may be provided on the mounting structure, and at least a tip of the projecting part may be hardened to provide a bearing surface. There may be a pad of hardened material on the print head with which the projecting part engages.

The printing apparatus may be an intermittent printer in which during printing, the print head moves at the printing station and the substrate and carrier are stationary or are moved, and the backing member is stationary during printing. Alternatively, during printing the print head moves at the printing station and the substrate and carrier are stationary or are moved, and the backing member moves with the print head relative to the substrate and carrier.

In another embodiment the apparatus is a continuous printer in which the print head is stationary at the printing station and the backing member is stationary, whilst the substrate and carrier move past the print head.

In each case, the print head is moved at least towards the substrate just prior to printing by, for example, a single acting actuator, and the print head moves away from the subject under the action of a spring. In another example, the print head is moved towards the substrate just prior to printing to an in use position, and is moved away from the substrate to a retracted position between printing, by a double acting actuator. The double acting actuator may move the print head in response to control signals from the controller of the printer, and the double acting actuator may, in response to a specific control signal from the controller, move the print head away from the substrate beyond the retracted position. When the print head is thus moved away from the substrate beyond the retracted position, fresh carrier may be threaded around the feed path, or other maintenance operations carried out on the printing apparatus which would not otherwise be convenient or possible with the print head in either its in use or retracted positions.

The specific control signal from the controller may be generated in response to a manual input, but alternatively is generated in response to a signal from a substrate thickness sensor which senses the thickness of the substrate, when the sensor senses that a thick part of the substrate is about to pass through the printing station. Thus for example where the substrate is continuous packaging yet to be divided into individual packages, e.g. after filling with product, seams between individual packages are thicker than the remaining substrate. By moving the print head away from the substrate beyond the retracted position, the thick part(s) of the substrate may pass through the printing station, and there is no need to arrange for the retracted position of the print head to be further away from the substrate than is desirable for efficient printing.

The printing apparatus may include a carrier ribbon supply spool and a carrier ribbon take-up spool, the carrier ribbon feed path being from the supply to the take-up spool through the printing station.

Conventionally in a printing apparatus the take-up spool is driven by a low torque, low speed stepper motor. The supply spool may be driven too but typically is free to rotate, and is braked to prevent over paying-out of ribbon. Because carrier ribbon is very thin and easily broken, it has been proposed to use a shuttle to move the ribbon during printing, so that the inertia of the (full) supply spool does not need to be overcome to accelerate the ribbon up to speed. However, mechanically such arrangement is complex. Moreover, although a stepper motor can rotate the take-up spool to achieve desired rotations of the take-up spool, such movements are incremental so that spool movements between increments cannot be achieved. It will be appreciated that because of the changing effective diameters of the spools as the supply spool empties and the take-up spool fills, in order to achieve accurate constant ribbon movements, the spool movement has to be correlated with changing spool effective diameters.

Desirably therefore in a printing apparatus of the invention, each of the take-up and supply spools are driven by a drive motor so that the supply spool and take-up spool can be rotated when it is desired to feed ribbon, carefully to control the ribbon movement around the ribbon feed path. Moreover although conventionally such printing apparatus are handed, so that printing can only be performed with the substrate and carrier and/or print head moving in one direction, by providing a pair of driven spools, the printer may be operated bi-directionally.

Furthermore preferably the motors driving the spools are each a D.C. such as a servo motor. Although D.C. servo motors which can accurately be controlled tend to be more expensive than comparable stepper motors, their employment means that no braking mechanism is required for the supply spool and more accurate ribbon movements around the ribbon feed path can be achieved than with a stepper motor, making their use economically acceptable.

The D.C. servo motors may be of the brushed or brushless kind.

To enable the D.C. servo motors accurately to be moved to achieve desired ribbon movements, each of the supply and take-up spool may have a rotation sensor such as an encoder to sense spool rotation. To enable the spools to be stopped quickly, the controller of the apparatus may provide a reverse voltage to the motors when required.

According to a second aspect of the invention we provide a printing apparatus having at a printing station, a print head with an array of heating elements individually selectable by a computer controller, a feed path for feeding carrier ribbon through the printing station, the carrier ribbon carrying a layer of thermally sensitive print medium, pixels of the thermally sensitive print medium being in use deposited on a print area of a substrate, by selectively energizing the heating elements, as the substrate and print head are relatively moved, the apparatus including a backing member and the substrate being positioned in use between the backing member and the carrier ribbon, and wherein during printing the print head is moved at the printing station along the substrate and carrier, and the backing member is moved with the print head.

The printing apparatus of the second aspect of the invention may have any of the features of the printing apparatus of the first aspect of the invention.

According to a third aspect of the invention we provide a printing apparatus having at a printing station, a print head with an array of heating elements individually selectable by a computer controller, a feed path for feeding carrier ribbon through the printing station, the carrier ribbon carrying a layer of thermally sensitive print medium, pixels of the thermally sensitive print medium being in use deposited on a print area of a substrate, by selectively energizing the heating elements, as the substrate and print head are relatively moved, the apparatus including a backing member and the substrate being positioned in use between the backing member and the carrier ribbon, and wherein the printing apparatus includes a carrier ribbon supply spool and a carrier ribbon take-up spool, the carrier ribbon feed path being from the supply to the take-up spool through the printing station, each of the take-up and supply spools including a drive motor so that the supply spool and take-up spool are rotated when it is desired to feed ribbon.

The printing apparatus of the third aspect of the invention may have any of the features of the printing apparatus of the first aspect of the invention.

According to a fourth aspect of the invention we provide a method of printing utilising a printing apparatus having at a printing station, a print head with an array of heating elements individually selectable by a computer controller, a feed path for feeding carrier ribbon through the printing station, the carrier ribbon carrying a layer of thermally sensitive print medium, pixels of the thermally sensitive print medium being in use deposited on a print area of a substrate, by selectively energizing the heating elements, as the substrate and print head are relatively moved, the apparatus including a backing member and the substrate being positioned in use between the backing member and the carrier ribbon, the method including moving the print head prior to printing, towards the substrate to an in use position and after printing, away from the substrate to a retracted position, the method further including sensing the thickness of substrate and when sensing that a thick part of the substrate is about to pass through the printing station, moving the print head away from the substrate beyond the retracted position.

According to a fifth aspect of the invention we provide a method of printing utilising a printing apparatus having at a printing station, a print head with an array of heating elements individually selectable by a computer controller, a feed path for feeding carrier ribbon through the printing station, the carrier ribbon carrying a layer of thermally sensitive print medium, pixels of the thermally sensitive print medium being in use deposited on a print area of a substrate, by selectively energizing the heating elements, as the substrate and print head are relatively moved, the apparatus including a backing member and the substrate being positioned in use between the backing member and the carrier ribbon, the apparatus further including a carrier ribbon supply spool and a carrier ribbon take-up spool, the carrier ribbon feed path being from the supply to the take-up spool through the printing station, and each of the take-up and supply spools being driven by a D.C. servo drive motor so that the supply spool and take-up spool are rotated when it is desired to feed ribbon, each of the supply and take-up spool including a rotation sensor to sense spool rotation, the method including sensing the rotational position of each spool to provide inputs to the controller, and continuing to move both motors until a desired carrier ribbon movement is achieved.

The method of the fifth aspect of the invention may include at the end of a print, reversing the motors to rewind carrier ribbon not used in the previous printing operation so as to be available for printing in a subsequent printing operation.

According to a sixth aspect of the invention we provide a method of converting adapted to print in one direction to a printing apparatus adapted to print in an opposite direction, the printing apparatus having at a printing station, a print head with an array of heating elements individually selectable by a computer controller, a feed path for feeding carrier ribbon through the printing station, the carrier ribbon carrying a layer of thermally sensitive print medium, pixels of the thermally sensitive print medium being in use deposited on a print area of a substrate, by selectively energizing the heating elements, as the substrate and print head are relatively moved, the apparatus including a backing member and the substrate being positioned in use between the backing member and the carrier ribbon, and the apparatus further including a carrier ribbon supply spool and a carrier ribbon take-up spool, the carrier ribbon feed path being from the supply to the take-up spool through the printing station, and each of the take-up and supply spools being driven by a drive motor so that the supply spool and take-up spool are rotated when it is desired to feed ribbon, the method including replacing the supply and take-up spools with respectively take-up and supply spools, providing an input to the controller which responds by reversing the directions of rotation of the two spools during printing, whilst maintaining the orientation of the print head with respect to the substrate.

According to a seventh aspect of the invention we provide a method of printing using the printing apparatus having at a printing station, a print head with an array of heating elements individually selectable by a computer controller, a feed path for feeding carrier ribbon through the printing station, the carrier ribbon carrying a layer of thermally sensitive print medium, pixels of the thermally sensitive print medium being in use deposited on a print area of a substrate, by selectively energizing the heating elements, as the substrate and print head are relatively moved, the apparatus including a backing member and the substrate being positioned in use between the backing member and the carrier ribbon, the print head being mounted for movement along the substrate in a direction opposite to the direction the substrate is moved through the printing station, the method including operating the printing apparatus in continuous mode with the print head stationary at the printing station whilst the substrate is moved through the printing station at a speed in excess of a minimum speed necessary for continuous mode printing, sensing the substrate speed, and in the event that the substrate speed slows during printing, moving the print head at the print station along the substrate in a direction opposite to the direction the substrate is moved through the printing station so as to maintain a minimum relative speed between the substrate and print head for the remainder of the print.

In the method of the seventh aspect of the invention, if desired, substrate speed through the printing station may be predicted by the controller by providing to the controller data relating to conditions affecting substrate movement upstream or downstream of the printing apparatus.

The invention will now be described with reference to the accompanying drawings in which.

Figure 1:
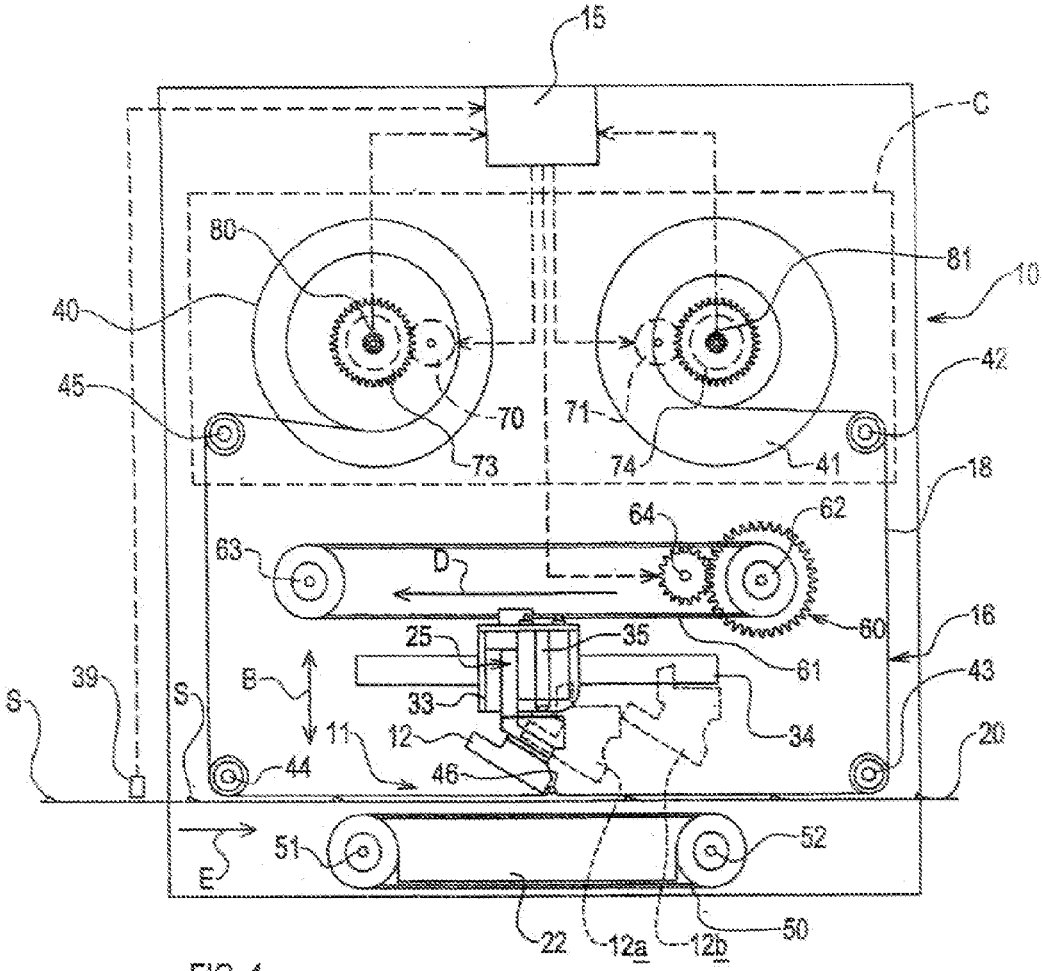
FIG. 1 is an illustrative side view of the printing apparatus in accordance with the invention.

Referring to the drawings, a printing apparatus 10 has at a printing station 11, a print head 12 with an array 13 of heating elements which are individually addressable and selectable by a computer control 15 during printing. A feed path 16 for carrier ribbon 18 extends through the printing station 11, the carrier ribbon 18 carrying a layer of thermally sensitive print medium, pixels of the print medium being in use, deposited on a print area of a substrate 20 at the printing station 11 when the heating elements of the array 13 are selectively energised. During printing the substrate 20 and print head 12 are relatively moved as hereinafter described.

The printing apparatus 10 further includes a backing member 22 or anvil which supports the substrate 20 during printing, the substrate 20 thus in use extending between the backing member 22 and the carrier ribbon 18.

The print head 12 is mounted by a mounting structure 25 for generally linear movement towards and away from the substrate 20 as indicated by the arrow B. The mounting structure 25 has a first 25*a* and a second 25*b* part, the second part 25*b* extending from an end of the first part 25*a*, in this example, at an angle of around 130° to the first part 25*a*.

Figure 2:
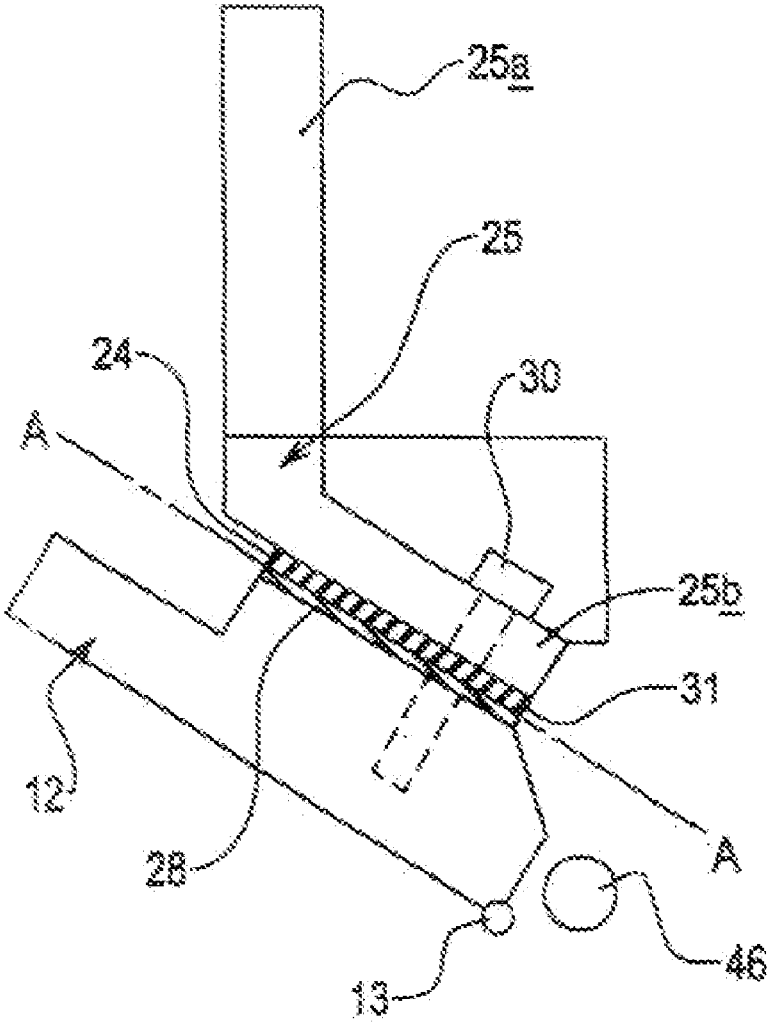
FIG. 2 is a detailed enlarged side view showing illustratively, a mounting structure and print head assembly for use in the printing apparatus of FIG. 1.
Figure 2A:
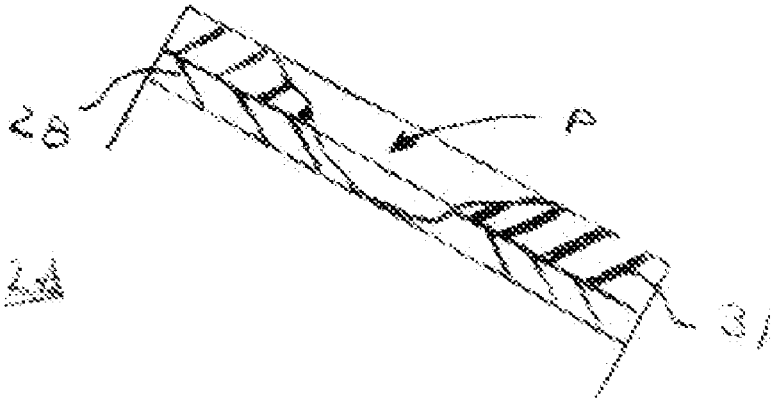
FIG. 2A is a cross-sectional side view showing illustratively, a projecting part of the printing apparatus.

In this example, the mounting structure 25 and print head 12 are coupled together by one or more fasteners 30, but in a manner which permits some compliance so that the print head 12 can accommodate mechanical irregularities, such as in the alignment of the anvil 22 or in the thickness of the substrate 20. The second part 25*b* of the mounting structure 25 has a generally planar lower surface 24 but projecting from that surface 24, there is a projecting part P (FIG. 2A) which in this example, is a generally straight ridge with a generally semicircular cross-section. The projecting part P extends between a free edge of the second part 25*b* of the mounting structure 25 and an opposite edge of the second part 25*b* to which the first part 25*a* is connected, generally centrally of the second part 25*b*, along an axis A which extends at angle of around 130° to the direction of movement B of the print head 12.

As the print head engages the substrate 20 through the ribbon 18 the projecting part P engages with a hardened steel member 28 attached to the print head 12. Furthermore, there is provided a resilient spacer 31 in the form of a soft rubber block, or a block or closed cell foam or similar material, in which case which, when the projecting part P is in contact with the hard surface 28, allows movement of the print head 12 relative to the mounting structure 25, pivoting about axis A particularly. The fastener 30 passes through an opening in the spacer 31 and the spacer 31, which is only slightly thicker than the extent of projection of the projecting part P, so that the spacer 21 becomes compressed to a small extent as the print head 12 engages the substrate 20. The print head 12 may move relative to the mounting structure 25 about the axis A but only to a very small extent so as to accommodate minor misalignments of the anvil 22 and minor variations of thickness of the substrate 20.

Where the mounting structure 25 is made of a soft metal, such as aluminium for example, the projecting part may need to be hardened, e.g. by heat treatment or coating, to provide a bearing surface.

The mounting structure 25 and print head are carried on a carriage 33 which is moveable along a track 34 in a direction generally along the substrate 20. The carriage 33 includes a double acting actuator 35 which when operated in response to the controller 15, is effective to move the mounting structure 25 and print head 12 linearly in the direction B between a retracted position shown in dotted lines in FIG. 1 at 12*a* and an in use position shown in FIG. 1 at 12 in full lines. The actuator 35 is preferably pneumatically operated, the controller 15 operating a valve or the like (not shown) to actuate the actuator 35 to cause print head 12 movement between the retracted position 12*a* and in use position 12.

Desirably, the double actuating actuator 35 normally operates only through part of its normal stroke to move the print head 12 as described. Thus if desired, in response to a specific control signal, the actuator 35 may move the print head 12 and mounting structure away from the substrate 20, to a position well beyond the retracted position 12*a*. Such position is indicated at 12*b* in the drawing.

This is useful to facilitate carrying out maintenance of operations on the printing apparatus 10. For example, a supply spool 40 and take-up spool 41 for the carrier ribbon 18 may be provided on a cassette C.

When it is desired to replace the cassette C in order to provide fresh carrier ribbon 18, the threading of the ribbon around the ribbon feed path 16 can be difficult with the print head 12 in its normal retracted position 12*a*. However, by moving the print head 12 away from the substrate 12 to position 12*b* beyond the retracted position 12*a*, more room is provided to facilitate threading the carrier ribbon 18 through the printing station 11.

Also, as the printing apparatus 10 may be used to print on substrate 20 which is continuous packaging including a plurality of individual packets yet to be separated, between the individual packets, there may be seams S where the substrate 20 is substantially thicker than otherwise, and in particular, is substantially thicker than the areas of the substrate 20 on which printing operations are to be performed.

Freely to permit the seams S of the substrate 20 to pass through the printing station 11, the print head 12 may be moved to position 12*b*. The controller 15 may provide a specific control signal to the valve of the actuator 35 to achieve this, for example in response to an input from a sensor indicated at 39, upstream of the printing apparatus 10, or within the printing apparatus 10, which warns the controller of the impending approach of a seam S. Of course, if desired a manual input may be provided to the controller 15, for example when it is desired to carry out a maintenance operation, which responds by providing the specific control signal to the valve of the actuator 35 to move the print head 12 to position 12*b*.

The printing apparatus 10 described is capable of operating in both continuous and intermittent modes of operation.

In a continuous mode of operation, the print head 12 is stationary at the printing station 11 as the substrate 20 and carrier ribbon 18, are moved through the printing station 11. Typically the print head 12 would be located along the track 34 at an end position at an initial position at the right hand side as shown in the drawings of the track 34. It can be seen that the carrier ribbon 18 is entrained around guide rollers 42-45 of the feed path 16, and around a peel roller 46 adjacent to the print head 12, which facilitates removal of the pixels of print medium from the carrier ribbon 18 and deposition of those pixels onto the substrate 20 during printing.

In intermittent mode, the print head 12 is moved during printing at the printing station 11 in direction D. During printing the print head 12 moves in a direction opposite to the direction E which the substrate 20 moves when delivered to the printing station 11, and the substrate 20 and carrier ribbon 18 may be stationary at the printing station 11 whilst the print head 12 moves, or may too be moving. At the end of a print, the print head 12 is returned to its initial right hand position ready for another print, once fresh substrate 20 has been presented at the printing station 11. During printing the print head 12 is of course in its in use position in which the print head 12 exerts some pressure through the carrier ribbon 18 onto the substrate 20 which is supported by the anvil 22, but during the return movement, the print head 12 is in its retracted position 12*a*.

If desired, the anvil 22 may include a support belt 50 which is entrained around a pair of rollers 51 and 52. One or both (or neither) of the rollers 51, 52 may be driven so that during print head 12 movement during printing, the belt 50 moves with the print head, preferably in synchronism with the print head. The belt 50 could be moved with the substrate 20 and carrier during continuous printing also if desired. The roller or rollers 51, 52 of the driven anvil 22 belt 50 may be driven by a stepper motor or any other kind of preferably electric motor (not shown) under the control of the controller 15.

Movement of the print head 12 and mounting structure 25 during intermittent printing and to return the print head 12 and mounting structure 25 to an initial position ready for subsequent printing, is achieved by a drive mechanism 60 which includes a drive belt 61 which is entrained round a motor 64 driven roller 62 and an idler roller 63. The carriage 33 is secured relative to the drive belt 61 and thus as the roller 62 is rotated, print head 12 and mounting structure 25 movement along the track 34 is achieved. Such movement is controlled and coordinated by the controller 15.

In the printing apparatus 10 of the invention, each of the take-up 41 and supply spools 40 are driven to achieve carrier ribbon 18 movement when it is desired to feed the ribbon 18. In continuous print mode, the spools 40 and 41 are each rotated during printing to move the carrier ribbon 18 with the substrate 20 relative to the stationary print head 12. In intermittent printing mode, the spools 40 and 41 may be stationary where the carrier ribbon 18 is held stationary whilst the print head 12 moves, or the spools 40 and 41 may be moved to achieve carrier ribbon movement 18 with the substrate 20 as the print head 12 is moved.

Each of the spools 40 and 41 has a respective drive motor 70 and 71 which in this example are D.C. servo motors driven under the control of the controller 15 but need not be the servo motors. The motors 70 and 71 drive their respective spools 40 and 41 through a drive train of gears 73, 74 in this example, although may drive the spool 40, 41 via drive belts. Gears 73, 74 are preferred for more accurate rotation.

Rotation of the respective spools 70 and 71 is sensed by a respective encoder 80 and 81 each of which provides an input to the controller 15 upon sensing spool 40, 41 movement. The controller 15 is programmed to ensure that the spool 40 and 41 rotation is synchronized to minimise the risk of breakage of the fragile carrier ribbon 18, and to achieve accurate amounts of carrier ribbon 18 feed so as to minimise wastage of carrier ribbon 18, which generally can only be used once.

To achieve rapid stopping of the spools 40, 41 without having to provide a braking mechanism, preferably for braking, the controller 15 is arranged to provide a reverse voltage to the motors 70, 71 to oppose continued spool 40, 41 rotation. In any event, to recover any unused ribbon 18 which may have passed the printing station 11 at the end of a continuous print, if desired the spools 40, 41 may be reversed to rewind such carrier ribbon 18 not used in the previous printing operation so as to be available in a subsequent printing operation.

It will be appreciated that the effective diameters of the storage 40 and take-up spools 41 will change in use as the supply spool 40 empties and the take-up spool 41 fills. The controller 15 is programmed to account for such changing effective diameters, and if necessary a carrier ribbon 18 tension checker may be provided to ensure that spool 40, 41 co-ordinated movement results in the feed ribbon 18 tension being maintained within acceptable limits It will be appreciated that a printing apparatus 10 operating in continuous mode requires relative movement between the substrate 20 and the carrier 18, and the stationary print head 12 to be maintained above a minimum relative speed, so that effective printing can take place. Small discrepancies in relative speed can be accommodated within limits only determined by the characteristic of the print head 12, particularly the ability of the heating elements of the array 13 to be heated and cooled as the print head 12 prints a row of pixels on the substrate 20 before proceeding to print the next row.

Printing apparatus 10 such as those described are conventionally provided on a packaging line and thus in continuous printing mode, movement of the substrate 20 through the printing apparatus 10 is dependent upon factors upstream or downstream of the packaging line. It is not uncommon for the substrate 20 suddenly to slow or even stop, for example as a result of a supply of substrate being changed from one supply apparatus to another, upstream of the printing apparatus 10 or a shortage of items to pack in the substrate downstream. For one example, the substrate 20 may be packaging for articles which are only available in batches downstream of the apparatus 10, with there being delays between the availability of one batch of articles and the next. Stoppage or slowing of the substrate 20 during a print can present problems, and typically such a print is later rejected.

To prevent wastage, preferably the substrate speed 20 determined by the sensor 39 is used by the controller 15 as follows.

Whilst substrate 20 is arriving at the printing station 11 at a speed above a minimum delivery speed, the printing apparatus 10 may be operated conventionally in continuous printing mode. In the event that during the printing operation the sensor 39 senses that the substrate 20 slows to a speed below the minimum printing speed, or even stops, the controller 15 responds by moving the print head 20 along the track 34 in a direction opposite to the direction of arrival of the substrate 20 at the printing station 11, so as to maintain a minimum relative speed between print head 12 and the substrate 20. Thus during a printing operation, the apparatus 10 may essentially be changed from operating in continuous printing mode, to operating in intermittent printing mode. At the end of a printing operation, or when the substrate 20 commences movement again at a speed above the minimum relative printing speed, the print head 12 may be returned to its initial right hand position along track 34 and the printing apparatus 10 again operated conventionally in continuous printing mode.

Such slowing or stopping of the substrate 20 may be predicted by the controller 15, from data fed to the controller 15 relating to conditions affecting substrate 20 movement upstream or downstream of the printing apparatus 10.

By virtue of the spools 40 and 41 each being driven by a respective motor 70 and 71, the printing apparatus may be operated bi-directionally, so as to accommodate the substrate 20 moving either from left to right (direction D) as described in this example, or from right to left. Of course, to ensure that a fresh supply of carrier ribbon 18 is available, the cassette C may need to be changed so that instead of the supply spool being at position 40, the supply spool with fresh carrier ribbon 18 is at position 41.

Whereas the orientation of the print head 12 may be reversed for example by reversing the mounting structure 25 and its mounting in carriage 33, with a suitable print head 12, and particularly because the print head 12 is moved linearly in direction B from the retracted 12*a* to in use position 12 rather than pivoted, the print head 12 may be retained in the orientation indicated in the drawing even though the substrate 20 is moved, or the print head 12 is moved in an opposite direction to that described in detail above during printing. Of course, where the anvil 22 is of the kind which moved with the print head 12, the direction of movement of the anvil belt 50 would need to be reversed too, and the peel roller 46 may need to be provided at an opposite side of the array 13 of the print head 12 to that shown with the carrier ribbon 18 entrained around it, so that pixels may be peeled from the carrier ribbon 18 in the opposite directions.

Thus the print head 12 would rest at an initial left hand position of track 34 rather than the right hand position as described, and when it is desired to move the print head 12 at the printing station 11 during printing, this would be from left to right, with the controller 15 moving the print head 12 to its in use position in direction B.

Various modifications are possible without departing from the scope of the invention. Particularly, the method of moving the print head 12 at the print station both along the track 34 and between the retracted 12*a* and in use positions 12 may be achieved otherwise than as described. For example, movement of the print head 12 towards and away from the substrate 20 may be performed by a single acting actuator of carriage 33, and movement to the retracted position 12*a* may be achieved by a spring.

The spools 40 and 41 need not be provided on a cassette C mechanism as described but may otherwise be provided e.g. on a base plate of the printing apparatus 10, although a cassette mechanism C is more convenient as it provides a quicker change of carrier feed ribbon 18 when desired.

The motors 70, 71 need not be D.C. servo motors as described but one or both may be other kinds. The motors 70, 71 may be brushed or brushless.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A printing apparatus having at a printing station, a print head with an array of heating elements individually energisable by a computer controller, a feed path for feeding carrier ribbon through the printing station, the carrier ribbon carrying a layer of thermally sensitive print medium, pixels of the thermally sensitive print medium being in use deposited on a print area of a substrate, by selectively energising the heating elements, as the substrate and print head are relatively moved, the apparatus including a backing member and the substrate being positioned in use between the backing member and the carrier ribbon, and wherein the print head is mounted by a mounting structure for generally linear movement towards and away from the substrate, one of the mounting structure and print head including a projecting part which projects towards the other and at least during printing, engages with the other of the mounting structure and print head, there being a resilient member between the mounting structure and the print head, which allows resiliently resisted movement between the mounting structure and print head with the projecting part engaged with the other of the mounting structure and print head, and there being at least one fastener to couple the mounting structure and print head together.

2. An apparatus according to claim 1 wherein between the print head and mounting structure there is provided a resilient spacer, the spacer having a thickness slightly greater than the extent of projection of the projecting part.

3. An apparatus according to claim 1 wherein the projecting part is provided on the mounting structure, and at least a tip of the projecting part is hardened to provide a bearing surface.

4. An apparatus according to claim 3 wherein there is a pad of hardened material on the print head.

5. An apparatus according to claim 1 wherein the printing apparatus is an intermittent printer in which during printing, the print head moves at the printing station and the substrate and carrier are one of stationary and moveable, and the backing member is stationary during printing.

6. An apparatus according to claim 1 wherein during printing the print head moves at the printing station and the substrate and carrier are one of stationary and moveable, and the backing member moves with the print head relative to the is stationary during printing.

7. An apparatus according to claim 1 wherein the apparatus is a continuous printer in which the print head is stationary at the printing station and the backing member is stationary, whilst the substrate and carrier move past the print head.

8. An apparatus according to claim 1 wherein the print head is moved at least towards the substrate just prior to printing by a single acting actuator, and the print head moves away from the substrate under the action of a spring.

9. An apparatus according to claim 1 wherein the print head is moved towards the substrate just prior to printing to an in use position, and is moved away from the substrate to a retracted position between printing, by a double acting actuator.

10. An apparatus according to claim 9 wherein the double acting actuator moves the print head in response to control signals from the controller of the printer, and the double acting actuator, in response to a specific control signal from the controller, moves the print head away from the substrate beyond the retracted position.

11. apparatus according to claim 10 wherein the specific control signal from the controller is generated in response to a signal from a substrate thickness sensor which senses the thickness of the substrate, when the sensor senses that a thick part of the substrate is about to pass through the printing station.

12. An apparatus according to claim 1 wherein the printing apparatus includes a carrier ribbon supply spool and a carrier ribbon take-up spool, the carrier ribbon feed path being from the supply to the take-up spool through the printing station, each of the take-up and supply spools being driven by a drive motor so that the supply spool and take-up spool are rotated when it is desired to feed ribbon, the motors each being a D.C. servo motor and each of the supply and take-up) spool having a rotation sensor to sense spool rotation.

13. An apparatus according to claim 12 wherein to enable the spools to be stopped quickly, the controller of the apparatus provides a reverse voltage to the motors.

* * * * *